United States Patent [19]

Bowman

[11] 4,203,686

[45] May 20, 1980

[54] MANHOLE CONSTRUCTION

[76] Inventor: Harold M. Bowman, 18867 N. Valley Dr., Fairview Park, Ohio 44126

[21] Appl. No.: 925,390

[22] Filed: Jul. 17, 1978

[51] Int. Cl.[2] ..... E02D 29/14

[52] U.S. Cl. ..... 404/25; 220/301; 210/164; 285/DIG. 2; 52/20; 49/465; 49/35

[58] Field of Search ..... 404/25, 26; 52/19, 20, 52/21; 49/465, 35; 210/163, 164, 165; 220/298, 301; 285/377, DIG. 2

[56] References Cited

U.S. PATENT DOCUMENTS

| | | | |
|---|---|---|---|
| 1,580,541 | 4/1926 | Sherman | 220/301 X |
| 2,328,068 | 8/1943 | Harris | 220/301 |
| 2,661,863 | 12/1953 | Howe | 220/301 |
| 2,879,914 | 3/1959 | Fleckenstein | 220/301 |
| 3,920,347 | 11/1975 | Sauriol | 404/25 |
| 4,032,036 | 6/1977 | Sycle | 220/301 X |

*Primary Examiner*—Nile C. Byers, Jr.

*Attorney, Agent, or Firm*—Baldwin, Egan, Walling & Fetzer

[57] ABSTRACT

A liquid-tight manhole closure structure including a base frame having a manhole opening therein, a manhole cover for placement in the manhole opening, and a retainer ring for detachably securing the cover on the frame. The retainer ring and frame having peripheral coacting, detachably interlocking, cam surfaces for removably securing the ring to the frame. A resilient sealant is disposed between the cover and the frame to prevent liquid seepage through the manhole opening. The sealant may be vulcanized or otherwise secured directly to the periphery of the cover and/or to the frame.

10 Claims, 7 Drawing Figures

MANHOLE CONSTRUCTION

This invention relates to manhole closure structures and more particularly to a water-tight and positive locking manhole closure assembly that prevents drainage and storm water from seeping into the manhole and prevents unauthorized manhole entry and ejection of the cover from the manhole closure assembly due to vehicle traffic.

BACKGROUND OF THE INVENTION

Water infiltration into manholes has been a continuing problem with telephone companies, municipal public works departments and other public utility companies. For example, it is mandatory to segregate different types of municipal water systems. Statistics have shown that huge volumes of additional waste water must be treated because of water infiltrating into a sewer system via manholes. In the case of electric and gas utility underground systems, in many instances, almost continuous pumping of water is required before utility men can enter a manhole because of water infiltration through openings in the manhole cover or because the manhole cover forms an ineffective liquid seal.

Another, and equal problem, involves security of all underground systems using manhole frames and covers as entry stations. It has been a long-sought goal to provide strict locking security while also allowing easy authorized entry by respective personnel. Furthermore, locking the manhole cover into its respective frame has always been desirable because of high speed car, bus, and truck traffic on streets, arterials, and other expressway traffic.

SUMMARY OF THE INVENTION

Accordingly, an object of the present invention is to provide a manhole closure assembly that functions to positively seal off a manhole opening from liquid infiltration under all normal and even severe operating conditions and thereby prevent drainage and storm water from entering the manhole.

A further object of the invention is to provide a liquid-tight manhole closure assembly of the above type wherein the manhole cover may be quickly and easily positioned on or removed from the manhole base frame with a minimum of effort.

A further object of the invention is to provide positive locking to the manhole closure assembly of the above type providing unauthorized entry and security from highway traffic vehicles.

A further object of the invention is to provide a manhole closure assembly of the above type that is simple in construction, inexpensive to manufacture, and highly effective in operation.

Briefly, the foregoing objects are accomplished by the provision of a manhole structure assembly including a base frame having a manhole opening therein, with the opening having a manhole cover peripheral seat. A manhole cover is retained on the seat by a retainer ring having laterally projecting lugs spaced about the periphery of the ring, such lugs having cam surfaces which interlock and coact with like cam surfaces on the base frame adjacent the seat. In operation, the cover is first placed on the seat after which the retainer ring is placed on the cover and circularly twisted to engage the cam surfaces on the ring and frame and thus detachably lock the cover on the frame. The retainer ring may have a pair of spaced tool slots formed in its upper surface for receiving a bifurcated wrench to facilitate application of the ring to the base frame and removal therefrom. A suitable seal such as a rubber sealant may be bonded or otherwise secured to the seat and/or that peripheral portion of the cover undersurface which contacts the seat to further provide a fluid-tight sealed joint therebetween. A drainage recess passageway is provided in the base frame for draining any water that may accumulate in the frame exteriorly of the sealed joint.

Other objects and advantages of the invention will be apparent from the following description taken in conjunction with the drawings.

Figure 1:
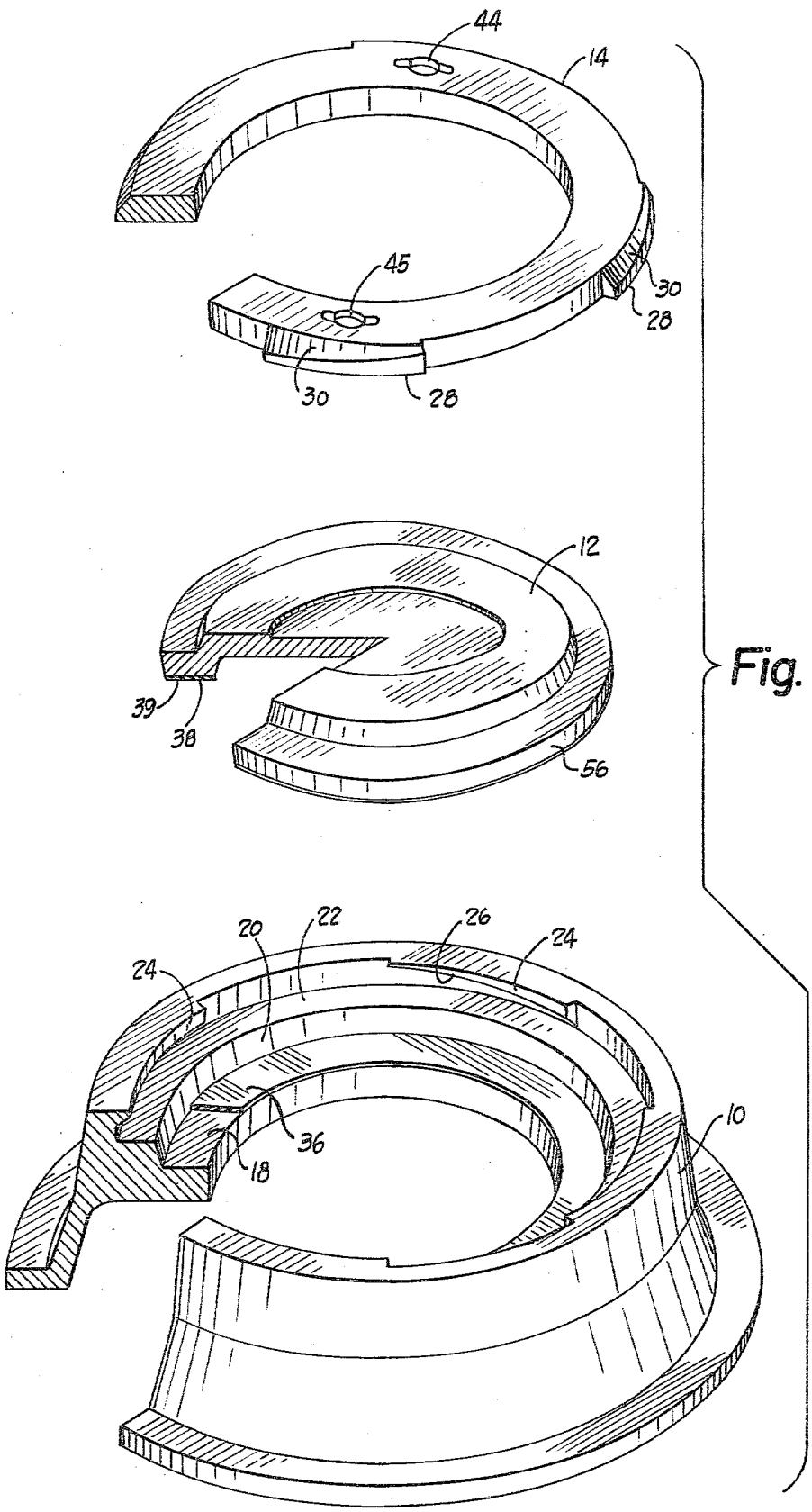
FIG. 1 is a perspective exploded view of a manhole structure of the invention and showing the base frame, the manhole cover and the retainer ring in position prior to assembly.
Figure 2:
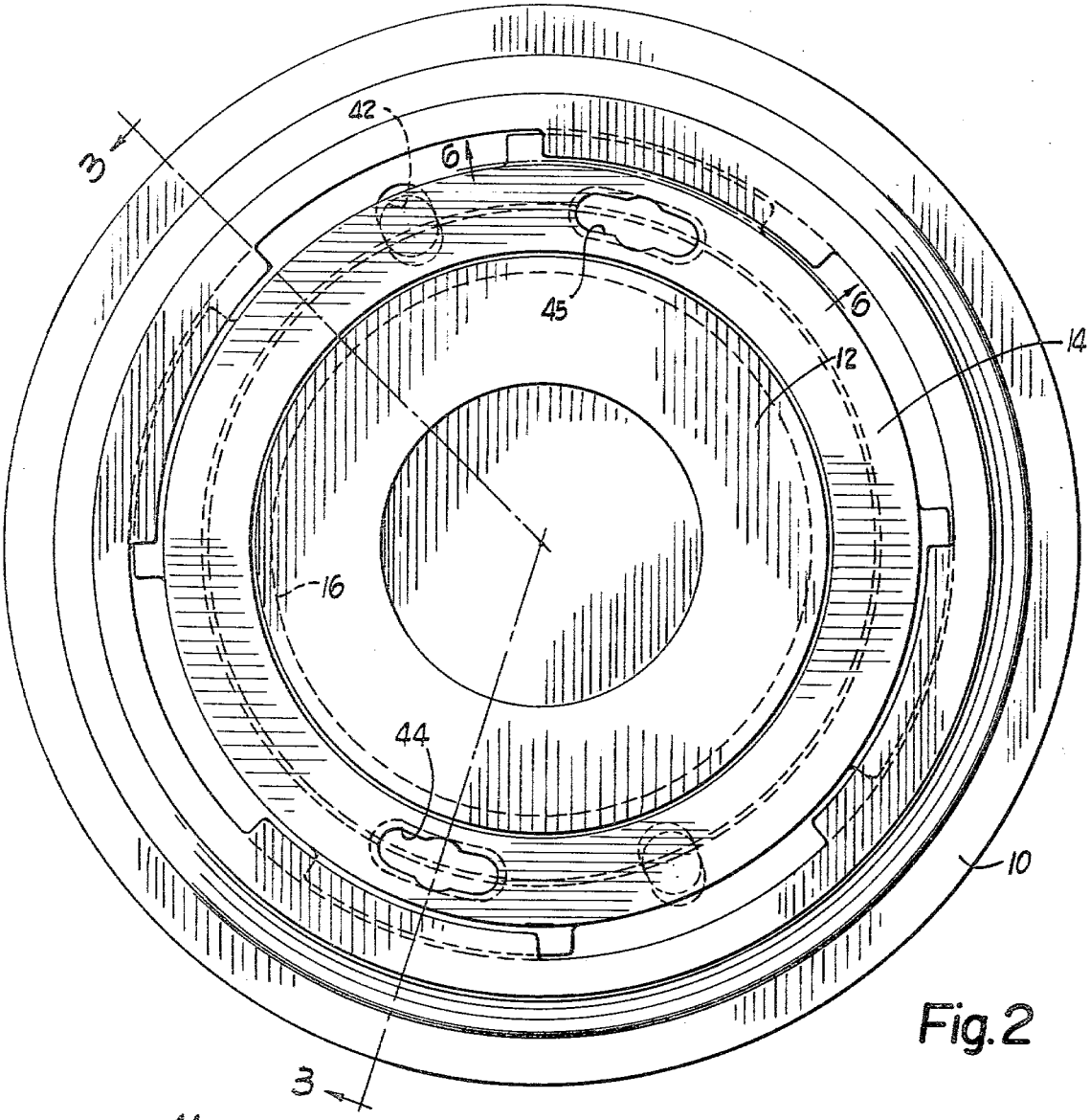
FIG. 2 is a plan view of the manhole structure of FIG. 1 and showing the base frame, the manhole cover and the retainer ring assembled.
Figure 3:
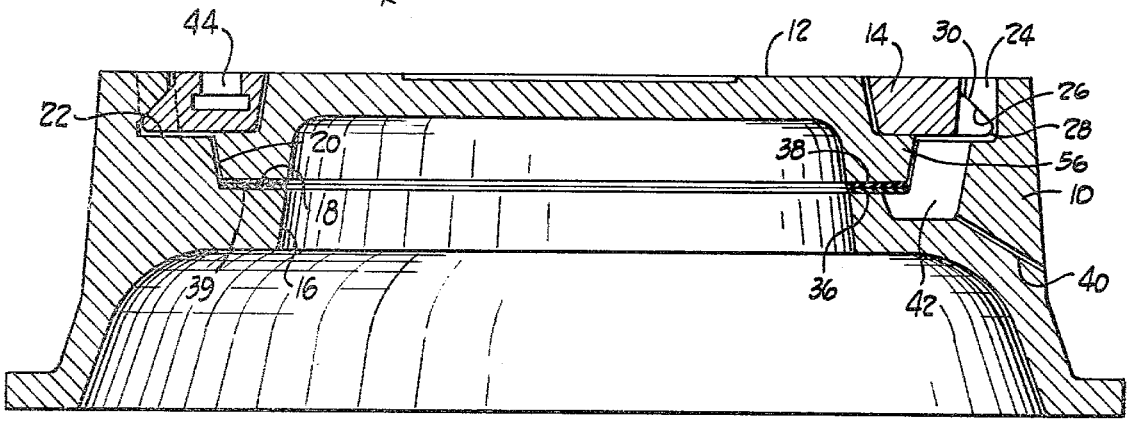
FIG. 3 is a vertical sectional view taken along the line 3—3 of FIG. 2.

Referring first to FIG. 1, the invention basically includes a base frame 10, a manhole cover 12 for placement in the base frame, and a retainer ring 14 for securing the cover to the frame in fluid-tight relation therewith. The base frame 10 has an annular manhole opening 16 (FIGS. 2 and 3) therein through which access is made to repair utility lines and the like. Immediately, above the opening 16 is a horizontal surface forming a peripheral inner seat 18 on which the cover 12 is seated.

The frame 10 has an upwardly sloping outwardly oblique surface adjacent the seat 18 defining a shoulder 20, which is adapted to restrict horizontal movement of the cover 12. Disposed above the shoulder 20 is a generally horizontal surface 22. The base frame 10 also includes cam means in the form of a plurality of inwardly projecting spaced frame lugs 24 formed around the inner upper periphery of the frame, such frame lugs having frame cam surfaces 26 facing downwardly of the frame.

Figure 6:
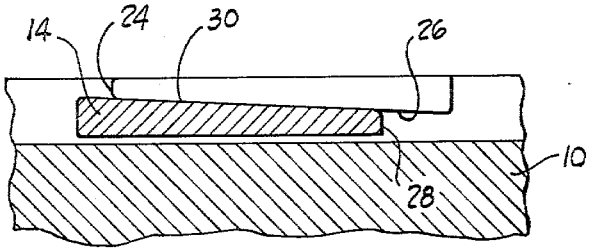
FIG. 6 is a portional sectional view taken along the line 6—6 of FIG. 2.

The retainer ring 14 has cam means in the form of a plurality of laterally projecting ring lugs 28 spaced about the periphery of the ring, such lugs having ring cam surfaces 30 which are adapted for camming coaction with the complimentary frame cam surfaces 26 on the frame for releasably locking the manhole cover 12 on the seat 18 of the frame, such camming action being best shown in FIG. 6.

To effect a fluid-tight seal, a resilient sealing material or sealant 34 (FIG. 5) may be vulcanized or otherwise bonded to the frame seat 18 and the shoulder 20. In the modification shown in FIGS. 2 and 3, the sealant 36, for example, is bonded only to the seat 18 and a sealant 38 is bonded to the cover peripheral undersurface 39. Thus, the sealant may be secured to the cover 12 and/or to the frame 10. The sealant may be formed of any suitable resilient material such as, for example, rubber.

A recess means in the form of a drainage passageway or recess 40 is formed in the base frame 10 and is disposed laterally outward of the manhole cover seat surface 18 for receiving liquid seepage from the juncture of the ring 14 and the cover 12 thence into the cavity 42, thus draining all water accumulating in the frame 10 exteriorly of the sealed joint between the frame and cover.

Figure 7:
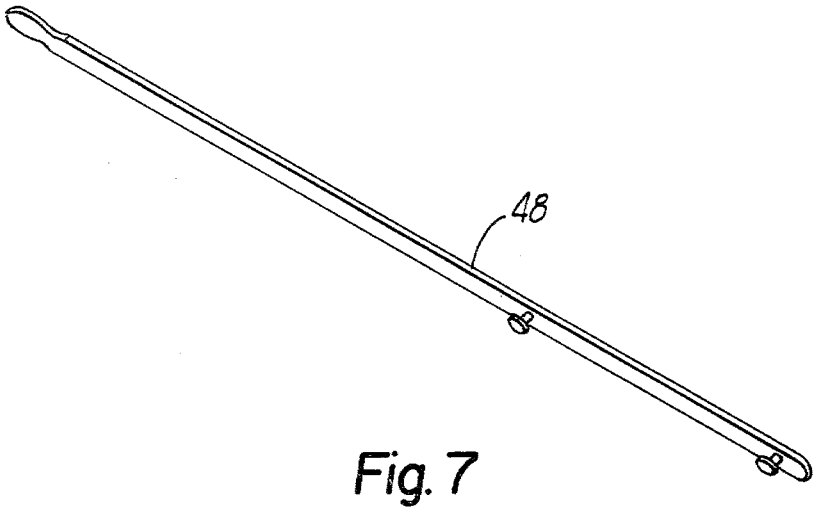
FIG. 7 is a perspective view of a bifurcated wrench of the type used for securing and removing the retainer ring.

The retainer ring 14 has a pair of spaced tool slots 44, 45, (FIG. 1) for receiving the bifurcated end portions of the bifurcated wrench 48 (FIG. 7) to facilitate manipulation of the ring 14 when attaching or removing it from the base frame 10.

Figure 4:
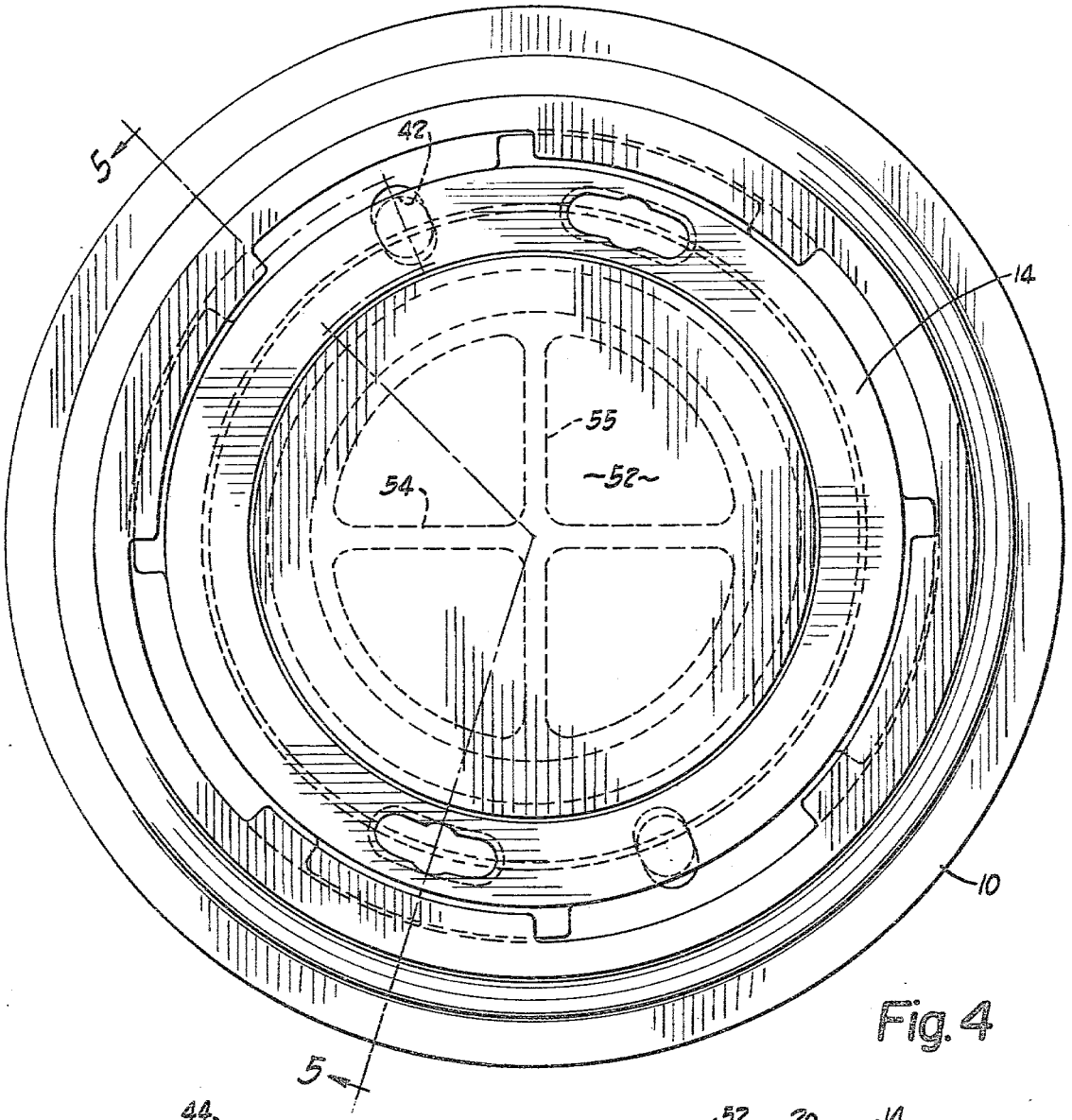
FIG. 4 is a plan view of a manhole structure of the invention similar to that of FIG. 2, but showing a modification thereof.
Figure 5:
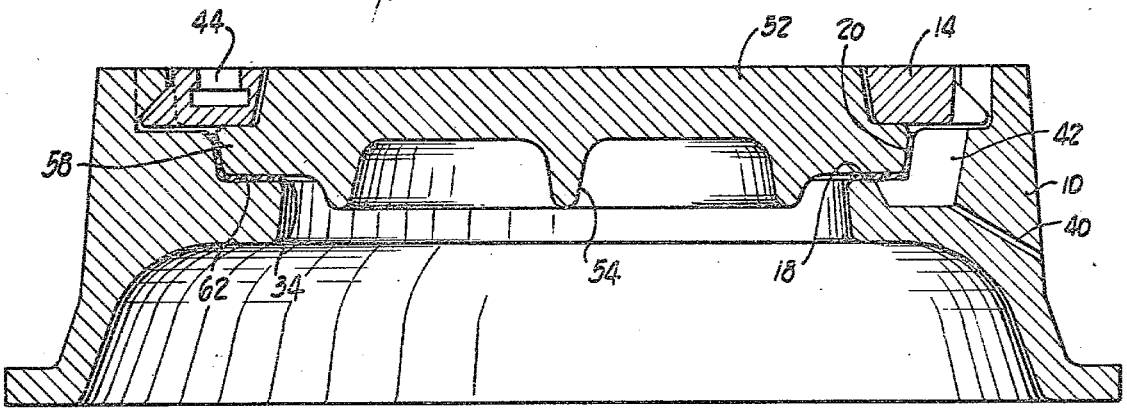
FIG. 5 is a vertical sectional view taken along the line 5—5 of FIG. 4.

The modification of FIGS. 4 and 5, discloses a cover 52 having reinforcing ribs 54 and 55 to provide a cover of added strength.

The covers 12 and 52 are each formed of a plate of generally circular configuration in plan and have a laterally projecting annular flange 56 and 58, respectively, extending the full circumference of the plate. Such flanges are disposed below the top surface of their respective covers and define, in part, a cover undersurface or seat surface 39, 62, respectively, on their underside adapted for sealing engagement with the manhole opening seat of the base frame on which the manhole cover rests to cover the manhole opening in the base frame.

Thus, the invention provides a manhole cover support assembly including a base frame 10 defining a manhole opening 16 and having a peripheral inner seat 18 for receiving the manhole cover 12 thereon. A retainer ring 14 coacts with the cover 12 and the base frame 10 for holding the cover in place on the seat 18. The retainer ring 14 includes means (such as, for example, the ring lugs 28 and its cam surfaces 30) which coact with means (such as, for example, frame lugs 24 and its cam surfaces 26) for removably securing the retainer ring 14 and the cover 12 to the base frame 10. Suitable sealing means 34, 36 or 38 coacting between the cover 12 and the seat 18 are provided for sealing the manhole opening 16 in the base frame 10 against ingress of water. There is further provided means (such as, for example, the slots or slot means 44, 45) in the retainer ring 14 is facilitating the orientation thereof into locking condition with respect to the frame 10, in coaction with the associated tool 48 as aforedescribed.

The terms and expressions which have been employed, are used as terms of description and not of limitation and there is no intention, in the use of such terms and expressions, of excluding any equivalents of the features shown or described, or portions thereof, but it is recognized that various modifications are possible within the scope of the invention claimed.

What is claimed is:

1. In a manhole cover assembly including a base frame defining a manhole opening and having a peripheral annular inner seat for receiving a manhole cover, an annular manhole cover seated on said seat, an annular retainer ring coacting with said cover and said frame for holding said cover in place on said seat, whereby said cover and said ring coact to present a substantially common flush surface with the top of said base frame, said retainer ring including means coacting with means on said frame for removably securing said retainer ring and said cover to said frame.

2. An assembly in accordance with claim 1 including sealing means coacting between said cover and said seat for sealing the manhole opening in said frame against ingress of water.

3. An assembly in accordance with claim 1 including means in said retainer ring for facilitating the orientation thereof into locking condition with respect to said frame.

4. A manhole cover in accordance with claim 3 wherein said last mentioned means comprises slot means in said retainer ring adapted for receiving an associated tool for causing rotation of the retainer ring with respect to said frame.

5. An assembly in accordance with claim 1 wherein said face frame comprises an upwardly sloping outwardly oblique surface adjacent said seat defining a shoulder adapted for restricting horizontal movement of said manhole cover, a generally horizontal surface disposed above said shoulder and adjacent thereto adapted for seating said retainer ring, and cam means disposed above the last mentioned seat adapted for camming coaction with cam means on said retainer ring for locking the retainer ring to said base frame.

6. An assembly in accordance with claim 2 wherein said retainer ring includes laterally projecting ring lugs spaced about the exterior periphery thereof, said ring lugs having ring cam surfaces thereon, said base frame having inwardly projecting spaced frame lugs formed around the inner upper periphery of the frame, said frame lugs having frame cam surfaces facing downwardly of the frame, said ring cam surfaces being adapted for camming coaction with the complementary frame cam surfaces on said base frame for locking said retainer ring to said base frame and thus locking said manhole cover on the seat of said base frame.

7. An assembly in accordance with claim 1 including recess means in said base frame disposed laterally outwardly of said manhole cover seat surface adapted for receiving liquid seepage between the juncture of said retainer ring and said manhole cover draining the liquid laterally of said base frame.

8. A manhole cover in accordance with claim 1 including sealing means vulcanized to the manhole cover seat and adapted to seal the manhole cover with respect to the base frame.

9. An assembly in accordance with claim 2 wherein said sealing means is secured to said base frame and covers at least a part of said seat surface.

10. An assembly in accordance with claim 1 wherein said sealing means is secured to said manhole cover and covers at least a part of said manhole cover seat.

* * * * *